US007013105B2

(12) United States Patent
Omata

(10) Patent No.: US 7,013,105 B2
(45) Date of Patent: Mar. 14, 2006

(54) IMAGE FORMING APPARATUS WITH CONTROL ADJUSTING BIAS OUTPUT BASED ON RECORDING MATERIAL SURFACE ROUGHNESS

(75) Inventor: Haruhiko Omata, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 90 days.

(21) Appl. No.: 10/759,124

(22) Filed: Jan. 20, 2004

(65) Prior Publication Data

US 2005/0008379 A1 Jan. 13, 2005

(30) Foreign Application Priority Data

Jan. 20, 2000 (JP) ..... 2003-011218

(51) Int. Cl.
*G03G 15/16* (2006.01)
*G03G 15/00* (2006.01)

(52) U.S. Cl. ..... 399/296; 399/45

(58) Field of Classification Search ..... 399/296, 399/45, 66

See application file for complete search history.

(56) References Cited

U.S. PATENT DOCUMENTS

| | | | | |
|---|---|---|---|---|
| 5,614,998 | A * | 3/1997 | Sanpe | 399/296 |
| 6,385,426 | B1 | 5/2002 | Kimura et al. | 399/302 |
| 6,442,356 | B1 | 8/2002 | Omata et al. | 399/66 |
| 6,895,204 | B1 * | 5/2005 | Shin | 399/296 |

FOREIGN PATENT DOCUMENTS

| | | |
|---|---|---|
| JP | 11-24443 | 1/1999 |

* cited by examiner

*Primary Examiner*—Susan Lee
(74) *Attorney, Agent, or Firm*—Fitzpatrick, Cella, Harper & Scinto

(57) ABSTRACT

An image forming apparatus has a movable image carrier for carrying a toner image thereon; an image forming section for forming the toner image on the movable image carrier; a transfer section for electrostatically transferring the toner image on the movable image carrier to a transfer medium at a transfer position; an electrifying section for electrifying the toner image on the movable image carrier before the toner image reaches the transfer position; and a bias applying section for applying a bias to the electrifying section. This image forming apparatus controls the bias output of the bias applying section in accordance with information about surface roughness of the transfer medium.

8 Claims, 5 Drawing Sheets

IMAGE FORMING APPARATUS WITH CONTROL ADJUSTING BIAS OUTPUT BASED ON RECORDING MATERIAL SURFACE ROUGHNESS

BACKGROUND OF THE INVENTION

1. Field of the Invention

The present invention relates to an image forming apparatus that transfers a toner image on an image carrier to an intermediate transfer member or a recording material, and also relates to an image forming apparatus that transfers a toner image on the intermediate transfer member to the recording material.

2. Description of the Related Art

To date, an image forming apparatus has been known that can form color images by performing a primary transfer and a secondary transfer as follows: in the primary transfer, toner images are formed on image carriers and are sequentially transferred to an intermediate transfer member; and in the secondary transfer, color images each comprising a plurality of toner images are formed on the intermediate transfer member, and thereafter these color images are collectively transferred to a recording material.

In such an intermediate transfer type image forming apparatus, the intermediate transfer member is not susceptible to scratches, and dust thereon such as paper powder can be easily cleaned off as compared with a photoconductive drum. Therefore, this type of image forming apparatus has the advantage of being adaptable to various recording materials, such as a cardboard, for example, having a basis weight on the order of 300 g/m$^2$.

Trends toward higher quality images in an image forming apparatus require importance to be placed on its adaptation not only to ordinary paper but also to recording materials having improved surface smoothness (i.e., having small surface roughness), such as art paper and coated paper.

However, such an image forming apparatus has a problem of being incapable of sufficient transfer to a cardboard material having a surface with bumps and dips provided thereon, such as embossed paper or debossed paper.

As a conventional art for preventing transfer defects due to the surface roughness of a recording material, for example, Japanese Patent Laid-Open No. 11-24443 discloses an arrangement in which, with regard to the electrostatic force that acts on a toner image when performing a transfer operation from an image carrier to a recording material, an electrostatic attractive force or an electrostatic repulsive force is selectively used in accordance with a surface roughness condition of the recording material.

However, the above-described art does not completely overcome transfer defects due to surface roughness.

The occurrence of a transfer failure due to surface roughness is attributable to a phenomenon that, when a transfer current is applied in a state where a toner image on an intermediate transfer member and a recording material are not sufficiently adhered to each other, an abnormal electric discharge occurs in a gap between the toner image and the recording material, thereby hindering the toner from being normally transferred. Therefore, simply changing a method for applying a transfer electric field provides no basic solution to the problem.

SUMMARY OF THE INVENTION

It is an object of the present invention to provide an image forming apparatus with improved transfer stability irrespective of the surface roughness of a transfer medium.

To achieve the above-described object, the present invention provides an image forming apparatus that includes a movable image carrier for carrying a toner image thereon; an image forming section for forming the toner image on the movable image carrier; a transfer section for electrostatically transferring the toner image on the movable image carrier to a transfer medium at a transfer position; an electrifier for electrifying the toner image on the movable image carrier before the toner image reaches the transfer position; a bias applying section for applying a bias to the electrifier; and a control unit for controlling the bias output by the bias applying section in accordance with information about surface roughness of the transfer medium.

In accordance with another aspect of the present invention, the image forming apparatus includes an input device for inputting information about the surface roughness of the transfer medium wherein the control unit controls the bias output in accordance with the inputted information.

In accordance with still another aspect of the present invention, the image forming apparatus also includes surface roughness detecting means for detecting a surface roughness of the transfer medium. In this case, the control unit controls the bias output in accordance with the surface roughness detected by the surface roughness detecting means.

In accordance with other aspects of the present invention, the control unit may control the bias applying means so that a charge of the toner image on the movable image carrying carrier decreases as the surface roughness of the transfer medium increases, or so that the absolute value of the direct current component of the output of the bias applying means decreases as the surface roughness of the transfer medium increases, or wherein the bias applying means applies a bias in which a direct current component and an alternating current component are superimposed.

In still yet another aspect of the present invention, the movable image carrier comprises a photoconductor on which an electrostatic latent image is formed or where the movable image carrier is an intermediate transfer member.

Further objects, features and advantages of the present invention will become apparent from the following description of the preferred embodiments with reference to the attached drawings.

DESCRIPTION OF THE PREFERRED EMBODIMENTS

Hereinafter, embodiments according to the present invention will be described with reference to the accompanying drawings.

First Embodiment

Figure 1:
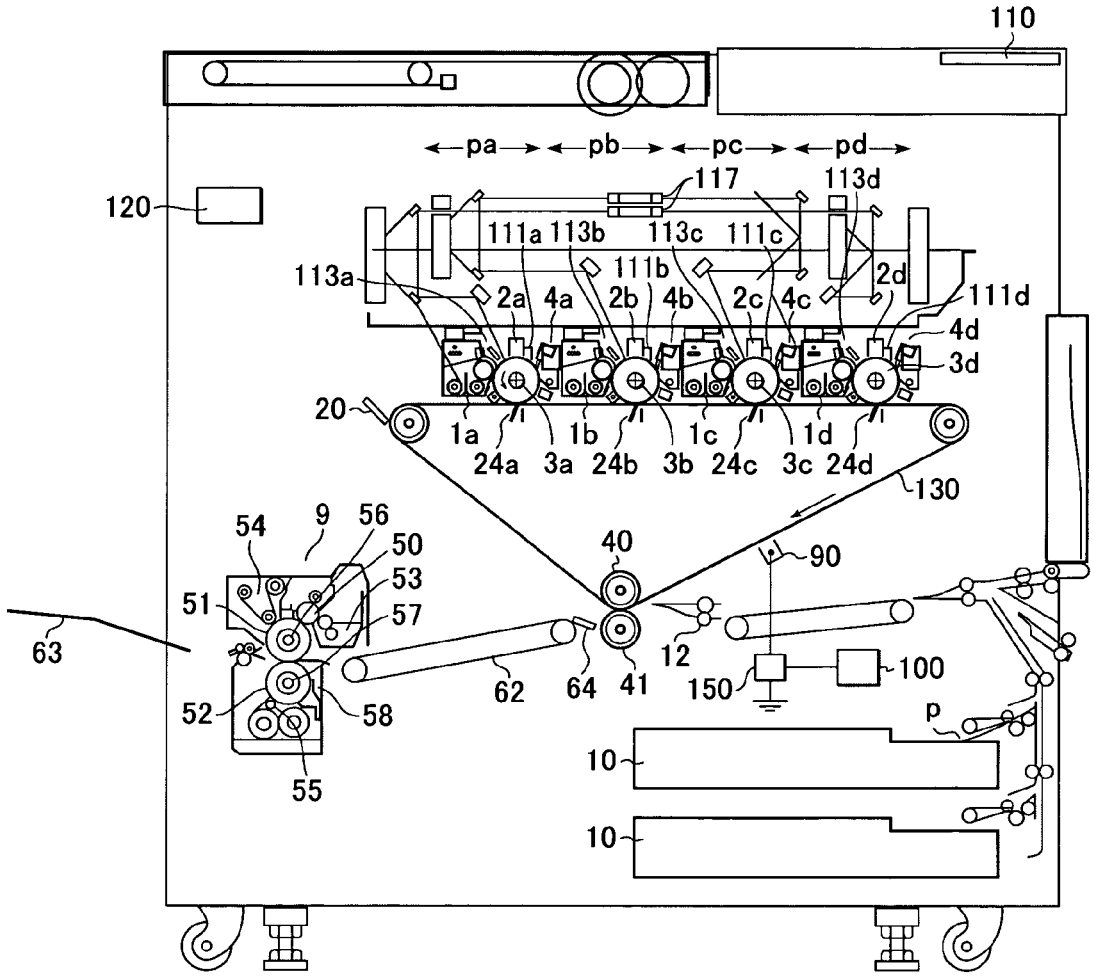
FIG. 1 is a longitudinal sectional view showing the schematic construction of an image forming apparatus according to a first embodiment of the present invention.

FIG. 1 shows an example of an image forming apparatus according to a first embodiment of the present invention.

The image forming apparatus shown in FIG. 1 is a full color laser printer with four colors. This image forming apparatus includes an intermediate transfer belt 130 serving as an intermediate transfer member on which toner images are once superimposed on one another; four image forming sections sequentially disposed from the upstream side along its moving direction (i.e., the direction indicated by the arrow along this belt in FIG. 1), which comprises a first "yellow" image forming section Pa, a second "magenta" image forming section Pb, a third "cyan" image forming section Pc, and a fourth "black" image forming section Pd.

The first to fourth image forming sections Pa, Pb, Pc, and Pd, respectively, have their exclusive image carriers, which are, in the first embodiment, drum type electrographic photoconductors (hereinafter referred to as "photoconductive drums") 3*a*, 3*b*, 3*c*, and 3*d*. A toner image of each of the colors is formed on a respective one of the photoconductive drums 3*a*, 3*b*, 3*c*, and 3*d*.

Around the photoconductive drums 3*a*, 3*b*, 3*c*, and 3*d*, there are respectively provided pre-exposure lamps 111*a*, 111*b*, 111*c*, and 111*d*; drum electrifiers (primary electrifiers) 2*a*, 2*b*, 2*c*, and 2*d*; potential sensors 113*a*, 113*b*, 113*c*, and 113*d*; developing units 1*a*, 1*b*, 1*c*, and 1*d*; transfer electrifiers 24*a*, 24*b*, 24*c*, and 24*d*; and cleaners 4*a*, 4*b*, 4*c*, and 4*d*. Above the main body of the image forming apparatus, there are provided a light source unit (not shown) and polygon mirrors 117.

Laser light emitted from the light source is scanned with polygon mirrors 117 rotated. Light flux of the scanned light is deflected by reflecting mirrors, and converges on the respective generatrices of the photoconductive drum 3*a*, 3*b*, 3*c*, and 3*d* by respective fθ lenses, thereby forming electrostatic latent images on the photoconductive drum 3*a*, 3*b*, 3*c*, and 3*d*, corresponding to respective image signals.

The developing units 1*a*, 1*b*, 1*c*, and 1*d*, respectively, are charged with a predetermined amount of yellow, magenta, cyan, and black toner as developers by a supply unit (not shown). The developing units 1*a*, 1*b*, 1*c*, and 1*d*, respectively, develop the electrostatic latent images on the photoconductive drums 3*a*, 3*b*, 3*c*, and 3*d*, and thereby visualize them as a yellow toner image, a magenta toner image, a cyan toner image, and a black toner image, respectively. The toner images formed on the photoconductive drums are sequentially transferred to the intermediate transfer belt 130 by the transfer electrifiers 24*a*, 24*b*, 24*c*, and 24*d*. The toner images superimposed on one another on the intermediate transfer belt 130 are transferred to a recording material (i.e., transfer medium) by a secondary transfer roller 41.

The recording material P is accommodated into a recording material cassette 10, and is supplied therefrom to a secondary transfer section through a paper feed roller, a plurality of conveying rollers and registration rollers 12.

The intermediate transfer belt 130 comprises a dielectric resin sheet, such as a polyethylene terephthalate resin sheet (PET resin sheet), a polyvinylidene fluoride resin sheet, or a polyurethane resin sheet. The intermediate transfer belt 130 may be a belt formed by superimposing opposite ends of the aforementioned dielectric resin sheet on each other and bonding them together into an endless shape, or alternatively the intermediate transfer belt 130 may be a seamless belt.

The recording material P on which a toner image has been transferred is conveyed to a fixing unit 9 by a conveying section 62. A separation guide 64 is used for stabilizing the front end of the recording material P.

The fixing unit 9 includes a fixing roller 51; pressure roller 52; heat-resistant cleaning members 54 and 55 for cleaning these fixing roller 51 and the pressure roller 52, respectively; roller heaters 56 and 57 provided within the fixing roller 51 and the pressure roller 52, respectively; an application roller 50 for applying a mold lubricant, such as dimethyl silicone oil, to the fixing roller 51; an oil reservoir 53 for this mold lubricant; and a thermistor 58 for detecting the surface temperature of the pressure roller 52 in order to control the fixing temperature.

With regard to the recording material P to which four color toner images have been transferred, color mixture of the toner images and fixation thereof to the recording material P are performed by fixing, whereby a full color image is formed on the recording material P and then discharged onto a paper discharge tray 63.

In the photoconductive drums 3*a*, 3*b*, 3*c*, and 3*d* that have completed transfer, residual toner left after transfer is removed by cleaning with the cleaners 4*a*, 4*b*, 4*c*, and 4*d*, respectively. Thereupon, the photoconductive drums 3*a*, 3*b*, 3*c*, and 3*d* are subjected to use in the next image formation. The toner and other foreign matter remaining on the intermediate transfer belt 130 are wiped away by a cleaning blade 20 provided on the surface of the intermediate transfer belt 130.

The intermediate transfer belt 130 used for the image forming apparatus with the foregoing arrangement comprises, as described above, a dielectric sheet such as a PET sheet, a polyvinylidene fluoride sheet, or a polyurethane sheet. Generally, these dielectric sheets each have generally a volume resistivity of $10^9$ to $10^{15}$ Ω·cm.

Next, the smoothness (surface roughness) of the recording material (transfer medium) will be described.

In general, the magnitude relationship among the surface roughness of recording materials is as follows: art paper<coated paper<ordinary paper<embossed paper. According to the ten-point average roughness Rz (JIS B 0601), the aforementioned art paper, coated paper, ordinary paper, and embossed paper, respectively, have asperities on the orders of 1 to 3 μm, 3 to 5 μm, 3 to 8 μm, and 15 μm.

Now, using such an image forming apparatus, experiments on image formation of a full color image were performed, with a secondary transfer current to be applied to the secondary transfer roller 41 set to 45 μA. As a result, with embossed paper, image defects occurred.

Embossed paper itself comprises various kinds of embossed paper. According to the experimental results, for example, embossed paper known under trade names of "Leathac 80 Tsumugi", "Leathac 66", and "Leathac 75 Momigami" each manufactured by TOKUSHU Paper Mfg. Co., Ltd. decreased in the image level in this order. This indicates that the image level decreases in a descending order of the smoothness of paper. In other words, the larger the surface roughness of paper, the lower the image level due to transfer defects.

As a result of measuring the amount of triboelectric charge of toner per unit weight (hereinafter referred to as a "toner tribo") before the secondary transfers in these experiments, the toner tribo was found to be approximately −31 μC/g.

With this being the situation, using an electrifier provided on the intermediate transfer member (i.e., post-electrifier) 90 as shown in FIG. 1, the toner tribo, which had been approximately −31 μC/g, was reduced in the absolute value to approximately −25 μC/g, and thereupon, similar experiments were performed. As a consequence, image defects were significantly reduced.

As the electrifier 90, a corona electrifier was used, which generates a charge by applying a bias to a wire for electrification by bias applying means (power supply) 150. However, the electrifier 90 is not limited to this type of electrifier.

The output control with respect to the post-electrifier 90 is performed by control means 100.

Figure 2:
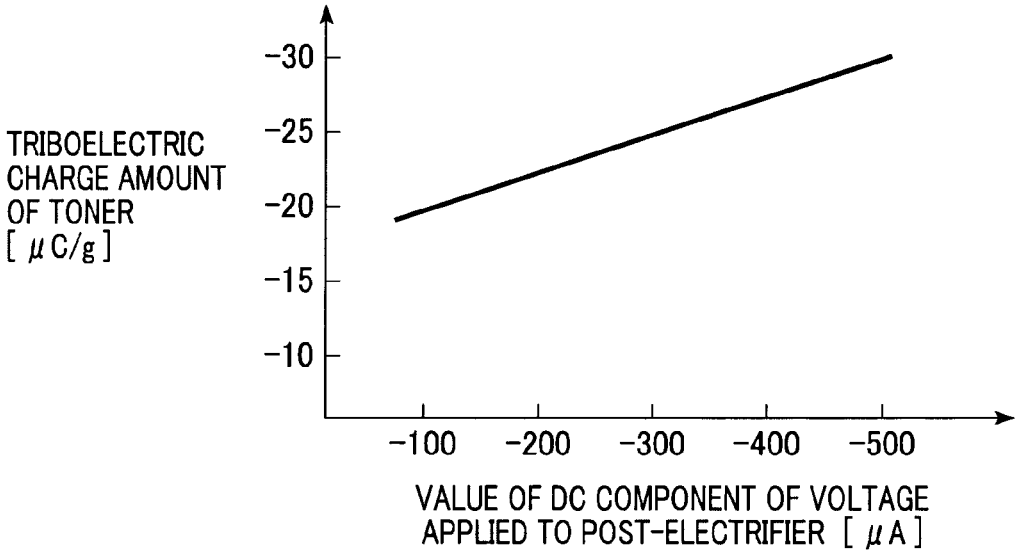
FIG. 2 is a graph showing the relationship between the output of a post-electrifier and the amount of triboelectric charge of toner.

FIG. 2 shows the relationship between the voltage applied to the intermediate transfer member electrifier 90 and the toner tribo. In this embodiment, an AC component (voltage) of 12 kVpp is superimposed on a DC component (voltage), and the superimposed voltage is outputted to the post-electrifier 90. According to this method, changing the DC component allows the toner tribo to be changed. For example, reducing the absolute value of the DC component enables the toner tribo to be reduced.

The occurrence of image defects was eliminated, by repeating such experiments and determining the output of the intermediate transfer member electrifier 90 corresponding to each kind of embossed paper different in the surface roughness from the other kinds of the embossed paper.

On the other hand, when attempting to perform a transfer at the same setting as ordinary paper, using paper with surface roughness smaller than ordinary paper, for example, cast-coated paper manufactured by Nippon Paper Industries Co., Ltd., scattering of images (character) took place. Such being the case, using the post-electrifier 90, the toner tribo, which had been approximately −31 μC/g before the secondary transfer, was increased in the absolute value to approximately −38 μC/g. As a result, no scattering of images occurred.

As described above, with respect to paper having an inferior surface smoothness (large surface roughness), reducing the toner tribo allows for a superior transfer. This is because the decreasing of the toner tribo reduces the mirroring force between the image carrier and the recording material, and provides easy-to-transfer conditions, thereby eliminating the occurrence of an abnormal discharge due to the application of a transfer current, even in a wide gap between the recording material and the image carrier.

On the other hand, for coated paper and art paper, each having a superior surface smoothness (small surface roughness), the adherence between the image carrier and the recording material is high, and therefore the above-described abnormal discharge does not occur. However, the decreasing of the toner tribo easily causes another type of image defect, namely, scattering of an image. Therefore, with respect to paper having superior surface smoothness, the toner tribo on the image carrier should be increased to eliminate the occurrence of this type of image defect. Here, increasing the value of a transfer current concurrently with the increase in the toner tribo, prevents the scattering of images more effectively.

In this embodiment, a portion where values of the surface roughness of paper is to be inputted is provided on an operation panel 110 so that a user can input numeral values corresponding to the paper to be used by the user, whereby the outputs of the intermediate transfer member electrifier 90 corresponding to the respective input values are produced.

Alternatively, the kind (trade name or the like) of paper may be inputted from the operation panel 110, whereby the control means 100 controls the electrifier 90 on an appropriate output condition corresponding to information about the kind of inputted paper based on a table prepared in advance.

Because the toner tribo varies depending on various parameters based on which the present apparatus is used, such toner characteristic, durability of a developer, and the like, it is preferable to use a detector 120 for detecting temperature and humidity of the atmosphere within the main body, and thereby control the output of the intermediate transfer member electrifier 90 based on the detection results.

In this embodiment, as a voltage to be applied to the post-electrifier 90, a bias formed by superimposing an AC output on an DC output is used. However, the post-electrifier 90 may be operated by the application of a DC component alone.

By virtue of the above-described features, the present invention can provide an image forming apparatus capable of performing a stable transfer even with respect to recording paper, such as embossed paper, having asperities.

Second Embodiment

In a second embodiment of the present invention, as its basic construction, the electrographic type image forming apparatus used in the above-described first embodiment, is employed.

Figure 3:
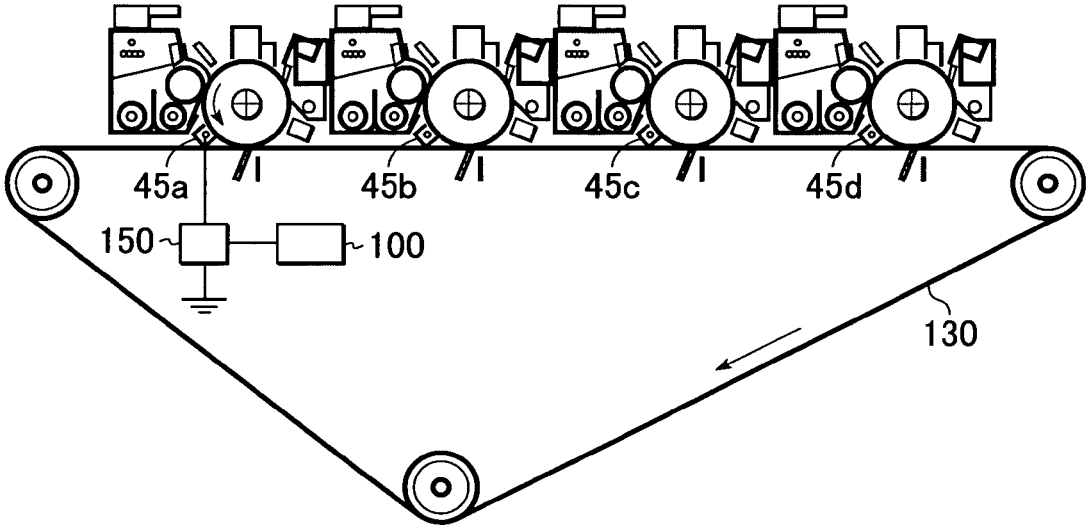
FIG. 3 is a longitudinal sectional view showing the schematic construction of an image forming apparatus according to a second embodiment of the present invention.

This embodiment is characterized in that, in order to change the toner tribo before the second transfer, the toner tribo before the first transfer is changed by electrifiers 45*a* to 45*d* each provided on the respective drums as shown in FIG. 3. FIG. 3 illustrates one portion of the image forming apparatus described in the first embodiment, the portion having the same construction as that of the first embodiment except for the addition of electrifiers 45*a* to 45*d*. In FIG. 3, the bias applying means 150 connected to the electrifier 45*a* is also connected to each of the other electrifiers 45*b*, 45*c*, and 45*d*.

Although the intended toner tribo is substantially the same as that in the first embodiment, an optimum output value of each of the drum electrifiers 45 is adjusted in order to adjust the toner tribo on the photoconductive drums.

The above-described features of the present invention make it possible to provide an image forming apparatus capable of performing a stable transfer even with respect to recording paper, such as embossed paper, having asperities.

Third Embodiment

In the foregoing embodiments, descriptions have been made of arrangements in which transfers are performed from the photoconductive drums 3*a* to 3*d* to the intermediate transfer belt 130. However, the present invention can also be applied to an apparatus in which transfers are performed from the photoconductive drums to paper in a direct manner. To be more specific, in a third embodiment, the present invention is also effective in an arrangement in which the output of the post-electrifier electrifying toner images on the photoconductive drums before transfer is controlled in accordance with the surface roughness of paper.

Figure 4:
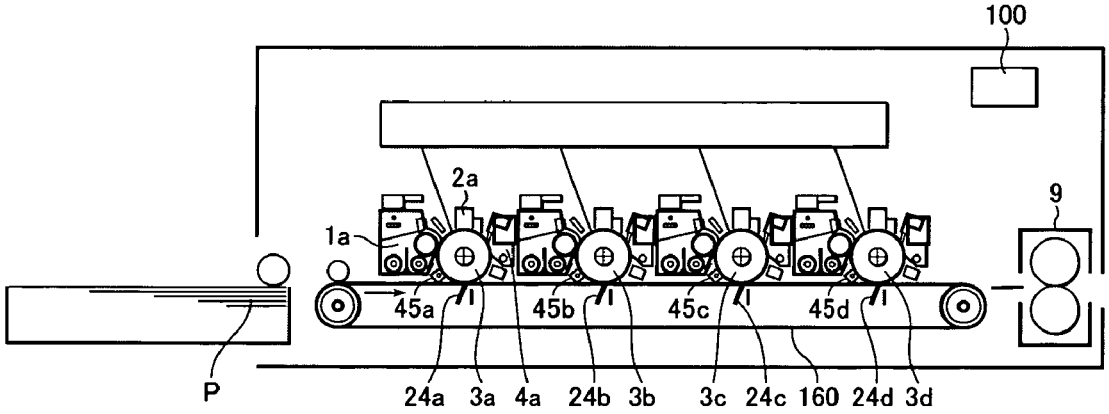
FIG. 4 is a longitudinal sectional view showing the schematic construction of an image forming apparatus according to a third embodiment of the present invention.

FIG. 4 shows an image forming apparatus according to the third embodiment of the present invention. In FIG. 4, the same components as those in the above-described embodiments are denoted by the same reference numerals. In this embodiment, the arrangement is such that toner images formed on a plurality of photoconductors 3*a* to 3*d* are sequentially transferred to a recording material conveyed by a transfer material conveying belt 160. Here, electrifiers 24*a* to 24*d*, respectively, are provided to the photoconductors 3*a* to 3*d* for electrifying toner images on the photoconductors 3*a* to 3*d* before being transferred to the recording material.

The control means 100 is used for controlling the operation of each of the electrifiers 24*a* to 24*d* so that the output corresponding to the surface roughness of each recording material is obtained, as described in the foregoing embodiment.

Fourth Embodiment

Figure 5:
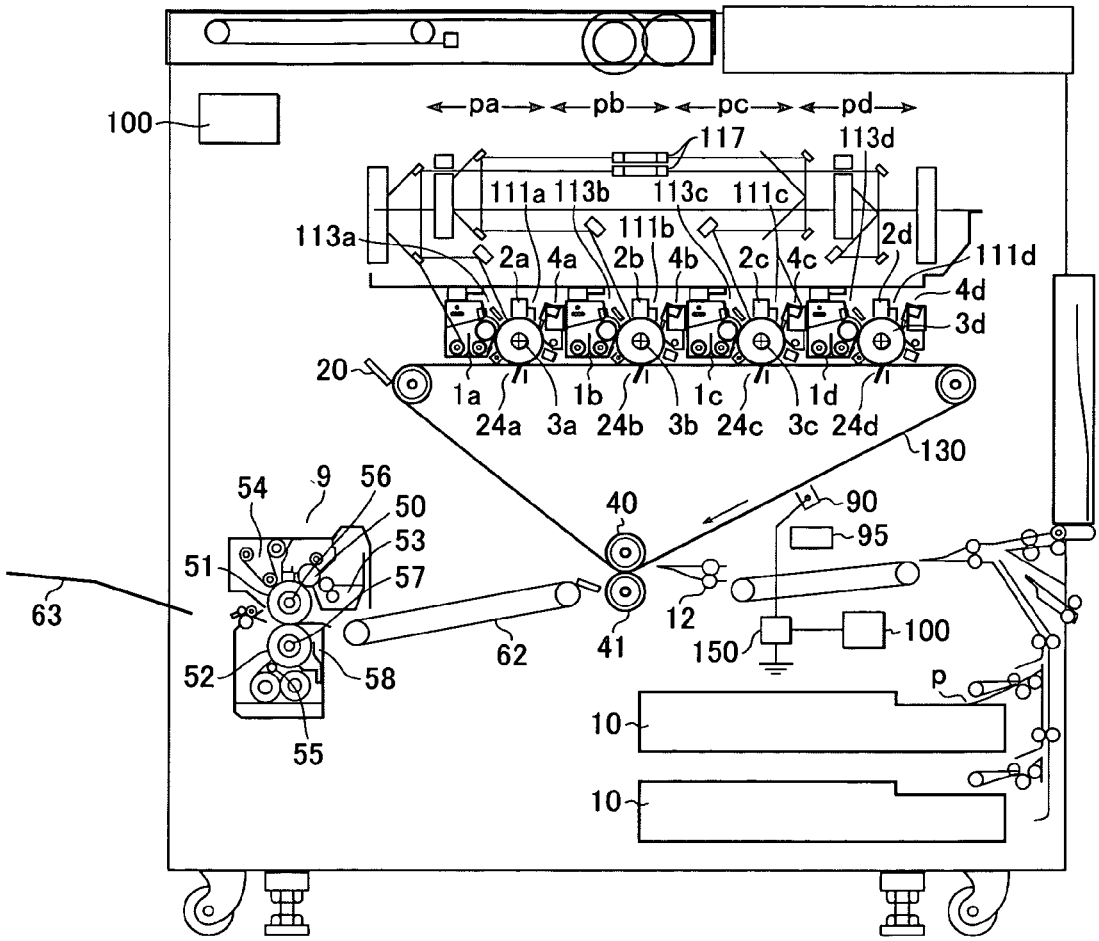
FIG. 5 is a longitudinal sectional view showing the schematic construction of an image forming apparatus according to a fourth embodiment of the present invention.

FIG. 5 shows an image forming apparatus according to a fourth embodiment of the present invention. This embodiment is characterized in that a surface sensor 95 for measuring the surface roughness of recording materials is added to the electrographic type image forming apparatus used in the above-described first embodiment.

The surface sensor 95 is arranged to comprise, for example, a light-emitting device and a light receiving device, which are not shown in FIG. 5. The light-emitting device comprises a light-emitting diode (LED) emitting near-infrared light, and the light receiving device comprises a CCD (charge-coupled device). Light emitted from the light-emitting device is reflected from the surface of a recording material in the course of being conveyed toward the secondary transfer section, and the reflected light enters the light receiving device. Taking advantage of the fact that reflecting conditions of light vary depending on the surface roughness of a recording material, the depth of asperities on the surface of the recording material is analyzed based on the output of the light receiving device (CCD), whereby an output corresponding to the surface roughness can be obtained.

The control means 100 determines the output of the intermediate transfer member electrifier 90 based on the above detection results, thereby reliably eliminating the occurrence of image defects.

The surface sensor is not restricted to the type described above but may include other known types which perform the required functions. A system such as a surface roughness meter using a cantilever employing a mechanical needle can also provide a similar effect.

As is evident from the foregoing, by virtue of the above-described features, the present invention can provide an image forming apparatus capable of performing a stable transfer even with respect to recording paper, such as embossed paper, having asperities.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. An image forming apparatus comprising:

a movable image carrier for carrying a toner image thereon;

image forming means for forming the toner image on the movable image carrier;

transfer means for electrostatically transferring the toner image on the movable image carrier to a transfer medium at a transfer position;

electrifying means for electrifying the toner image on the movable image carrier before the toner image reaches the transfer position;

bias applying means for applying a bias to the electrifying means; and control means for controlling the bias output by the bias applying means in accordance with information about surface roughness of the transfer medium.

2. The image forming apparatus according to claim 1, further comprising information input means for inputting the information about the surface roughness of the transfer medium, wherein said control means controls the bias output of said bias applying means in accordance with the information inputted into said information input means.

3. The image forming apparatus according to claim 1, further comprising surface roughness detecting means for detecting the surface roughness of the transfer medium, wherein said control means controls the bias output of the bias applying means in accordance with the surface roughness detected by said surface roughness detecting means.

4. The image forming apparatus according to claim 1, wherein said control means controls said bias applying means so that a charge of the toner image on the movable image carrier decreases as the surface roughness of the transfer medium increases.

5. The image forming apparatus according to claim 1, wherein said control means controls the bias output by said bias applying means so that an absolute value of a direct current component of the output of said bias applying means decreases as the surface roughness of the transfer medium increases.

6. The image forming apparatus according to claim 1, wherein said bias applying means is also for applying a bias in which a direct current component and an alternating current component are superimposed.

7. The image forming apparatus according to claim 1, wherein said movable image carrier comprises a photoconductor on which an electrostatic latent image is formed.

8. The image forming apparatus according to claim 1, wherein said image forming means comprises a photoconductor on which an electrostatic latent image is formed, a developer for developing the electrostatic latent image with toner, and a primary transfer means for transferring the toner image on the photoconductor to an intermediate transfer member; and wherein said movable image carrier is an intermediate transfer member.

* * * * *

UNITED STATES PATENT AND TRADEMARK OFFICE

CERTIFICATE OF CORRECTION

PATENT NO. : 7,013,105 B2
APPLICATION NO. : 10/759124
DATED : March 14, 2006
INVENTOR(S) : Haruhiko Omata It is certified that error appears in the above-identified patent and that said Letters Patent is hereby corrected as shown below:

COVER PAGE AT ITEM[30]:
Foreign Application Priority Data, "Jan. 20, 2000" should read --Jan 20, 2003--.

Signed and Sealed this

Twelfth Day of September, 2006

JON W. DUDAS
*Director of the United States Patent and Trademark Office*